US010104948B2

(12) United States Patent
Wilcher

(10) Patent No.: US 10,104,948 B2
(45) Date of Patent: Oct. 23, 2018

(54) HAIR PRODUCT APPLICATORS AND METHODS OF USING THE SAME

(71) Applicant: Karol E. Wilcher, Highland, IN (US)

(72) Inventor: Karol E. Wilcher, Highland, IN (US)

( * ) Notice: Subject to any disclaimer, the term of this patent is extended or adjusted under 35 U.S.C. 154(b) by 0 days.

(21) Appl. No.: 15/401,813

(22) Filed: Jan. 9, 2017

(65) Prior Publication Data

US 2017/0202333 A1 Jul. 20, 2017

Related U.S. Application Data

(60) Provisional application No. 62/388,161, filed on Jan. 19, 2016.

(51) Int. Cl.

| | |
|---|---|
| ***A46B 11/04*** | (2006.01) |
| ***A45D 19/02*** | (2006.01) |
| ***A46B 11/00*** | (2006.01) |
| *A45D 19/00* | (2006.01) |

(52) U.S. Cl.

CPC ..... *A45D 19/02* (2013.01); *A46B 11/0055* (2013.01); *A45D 2019/005* (2013.01); *A45D 2019/0041* (2013.01); *A45D 2019/0066* (2013.01); *A45D 2019/0083* (2013.01); *A45D 2200/055* (2013.01)

(58) Field of Classification Search

CPC ..... A46B 11/0055; A45D 2200/055; A45D 2019/0066; A45D 2019/0041; A45D 2019/0083

See application file for complete search history.

(56) References Cited

U.S. PATENT DOCUMENTS 4,934,388 A * 6/1990 Gibbs ..... A45D 19/02 132/112
5,289,835 A * 3/1994 Harlan ..... A45D 19/02 132/112

(Continued)

FOREIGN PATENT DOCUMENTS

GB 2390300 A * 1/2004 ..... A45D 19/02

OTHER PUBLICATIONS

The Engineer, "This Innovative Toothbrush Also Works as a Toothpaste" http://wonderfulengineering.com/this-innovative-toothbrush-also-works-as-a-toothpaste, Wonderful Engineering, Apr. 14, 2017 (3 pages).

*Primary Examiner* — Jennifer C Chiang
(74) *Attorney, Agent, or Firm* — Nixon Peabody LLP

(57) ABSTRACT

A device includes a pump and a brushhead. The pump includes a housing and plunger. The housing has an upper opening, a cavity configured to store a composition therein, and a tip having a dispensing opening. The plunger is slidably disposed within housing such that it is moveable with respect to the housing. The brushhead includes a first plurality of bristle bores and a second plurality of bristle bores, each of which extend from a bottom surface of the brushhead towards an opposing top surface and have a bristle bundle extending therefrom. The brushhead includes a generally central throughhole extending between the bottom surface and the opposing top surface. The pump is coupled to the brushhead via the tip of the housing such that actuation of the plunger causes a portion of the composition stored in the housing to be dispensed on at least a portion of the bristle bundles.

15 Claims, 6 Drawing Sheets

(56) References Cited

U.S. PATENT DOCUMENTS

| | | | | |
|---|---|---|---|---|
| 6,022,163 | A * | 2/2000 | Asfur | A45D 24/22 132/112 |
| 6,357,450 | B1 * | 3/2002 | Paice | A45D 19/0008 132/114 |
| 6,390,101 | B1 * | 5/2002 | Alexander | A45D 2/002 132/112 |
| 7,243,660 | B2 * | 7/2007 | Capristo | A45D 19/02 132/112 |
| 7,338,225 | B1 * | 3/2008 | Taylor | B05C 17/002 401/13 |
| 9,648,944 | B2 * | 5/2017 | Babrow | A46B 11/0062 |
| 2006/0163282 | A1 * | 7/2006 | Suzuki | B05B 11/3011 222/135 |
| 2007/0136958 | A1 * | 6/2007 | Draghiceanu | A45D 19/0008 8/405 |
| 2010/0132730 | A1 * | 6/2010 | Jung | A45D 19/02 132/116 |

* cited by examiner

HAIR PRODUCT APPLICATORS AND METHODS OF USING THE SAME

CROSS-REFERENCE TO RELATED APPLICATION

This application claims the benefit of U.S. Provisional Application No. 62/388,161, filed Jan. 19, 2016, which is hereby incorporated by reference herein in its entirety.

TECHNICAL FIELD

The present disclosure relates generally to devices and methods for dispensing a composition on a brush and, more particularly, to a hair product applicator for dispensing a relaxer agent on a brush.

BACKGROUND

Many individuals receive and/or apply a composition (e.g., a chemical treatment) to style their hair. For example, chemical treatments can be used to either relax (e.g., straighten) or curl hair. However, as the individual's hair grows subsequent to an initial treatment, the individual often needs to apply additional composition to maintain a uniform appearance of the hair, especially along the edges and/or the roots. To do so, individuals often purchase containers of a product along with a separate brush, which allows the individual to touch-up the newly grown, untreated hair. However, in many such instances, a significant portion of the product in the container is wasted because only a small amount may be required to achieve the desired appearance. Thus, new devices and methods for applying a hair product are needed. The present disclosure is directed towards addressing these and other problems.

SUMMARY

According to some implementations of the present disclosure, a hair product applicator includes a pump and a brushhead. The pump includes a housing and a plunger. The housing has (i) an upper opening, (ii) a cavity configured to store a composition therein, and (iii) a tip having a dispensing opening. The plunger is slidably disposed within the housing such that the plunger is moveable with respect to the housing and aids in preventing the composition from escaping through the upper opening of the housing. The brushhead includes a first plurality of bristle bores, a second plurality of bristle bores, and a generally central throughhole. The first plurality of bristle bores is adjacent to a first end of the brushhead and the second plurality of bristle bores is adjacent to an opposing second end of the brushhead. Each of the first plurality of bristle bores and each of the second plurality of bristle bores (i) extend\ from a bottom surface of the brushhead towards an opposing top surface of the brushhead and (ii) have a bristle bundle extending therefrom. The generally central throughhole extends between the bottom surface and the opposing top surface and is positioned between the first plurality of bristle bores and the second plurality of bristle bores. The pump is coupled to the brushhead via the tip of the housing such that actuation of the plunger causes at least a portion of the composition stored in the housing to be dispensed directly onto at least a portion of the bristle bundles.

According to some implementations of the present disclosure, a method for assembling a hair product applicator includes providing a housing having (i) an upper opening, (ii) a cavity, and (iii) a tip having a dispensing opening. A plunger is slidably engaged with the housing through the upper opening of the housing. A portion of the cavity is filled with a composition. The tip of the housing is sealed with a cap. The tip of the housing is coupled with a generally central throughhole of a brushhead including a first plurality of bristle bores and a second plurality of bristle bores. The first plurality of bristle bores is adjacent to a first end of the brushhead and the second plurality of bristle bores is adjacent to an opposing second end of the brushhead. Each of the first plurality of bristle bores and each of the second plurality of bristle bores at least partially extend from a bottom surface of the brushhead towards an opposing top surface. The generally central throughhole extends between the bottom surface and opposing top surface and is positioned between the first plurality of bristle bores and the second plurality of bristle bores. A bristle bundle is fixed in each of the first plurality of bristle bores and in each of the second plurality of bristle bores such that a least a portion of the bristle bundles is positioned to directly receive at least a portion of the composition thereon responsive to (i) the cap being removed, thereby unsealing the tip and (ii) the plunger moving with respect to the housing towards the tip, thereby causing a portion of the composition to be dispensed through the dispensing opening via the tip.

These and other aspects of the present disclosure will become more apparent from the following detailed description of the systems and methods in conjunction with the accompanying drawings.

Figure 1A:
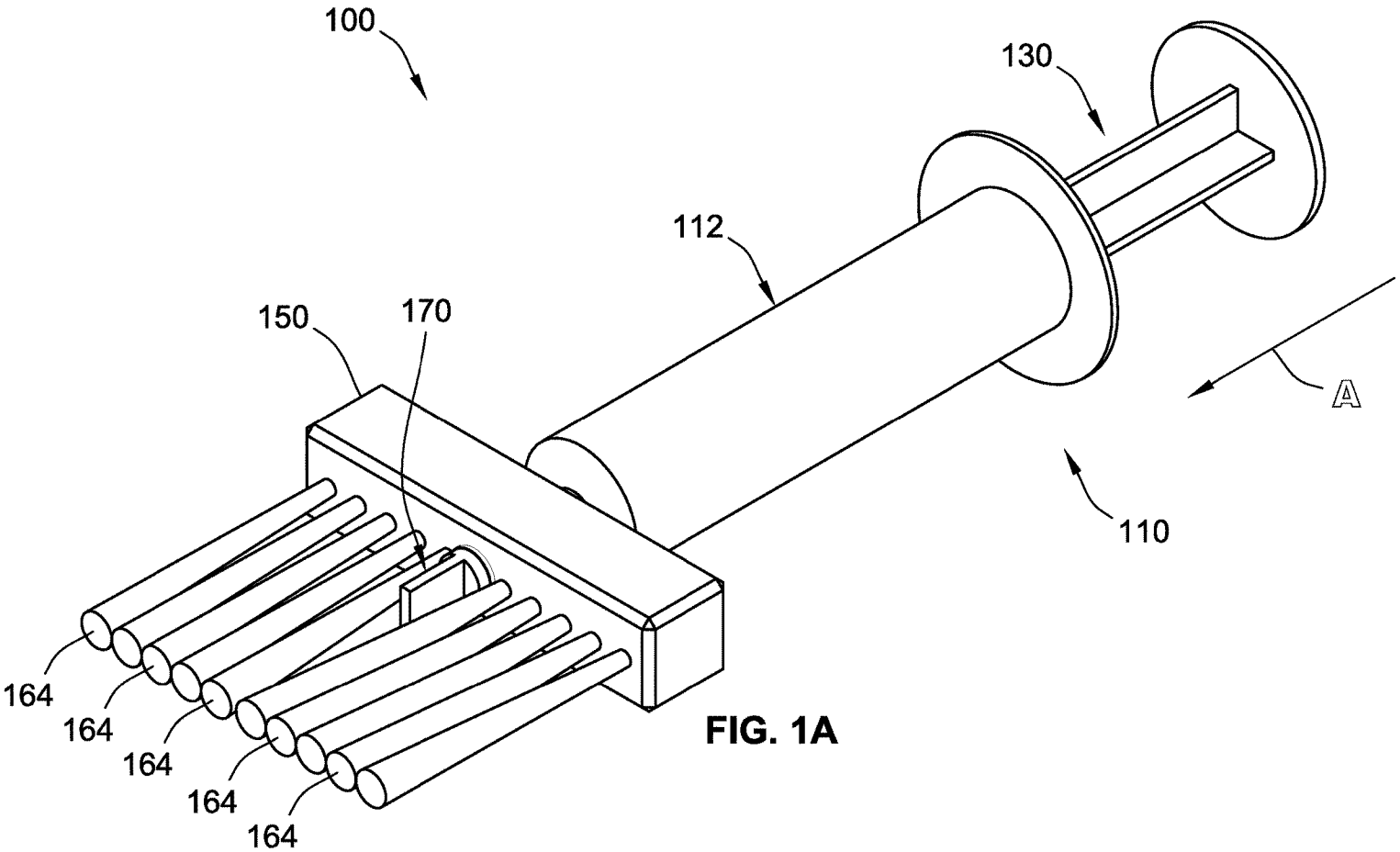
FIG. 1A is an assembled perspective view of a hair product applicator according to some implementations of the present disclosure.

The present disclosure is susceptible to various modifications and alternative forms, and some representative implementations have been shown by way of example in the drawings and will be described in detail herein. It should be understood, however, that the inventive aspects of the disclosure are not limited to the particular forms disclosed. Rather, the disclosure is to cover all modifications, equivalents, and alternatives falling within the spirit and scope of the present disclosure as defined by the appended claims.

DETAILED DESCRIPTION

Figure 1B:
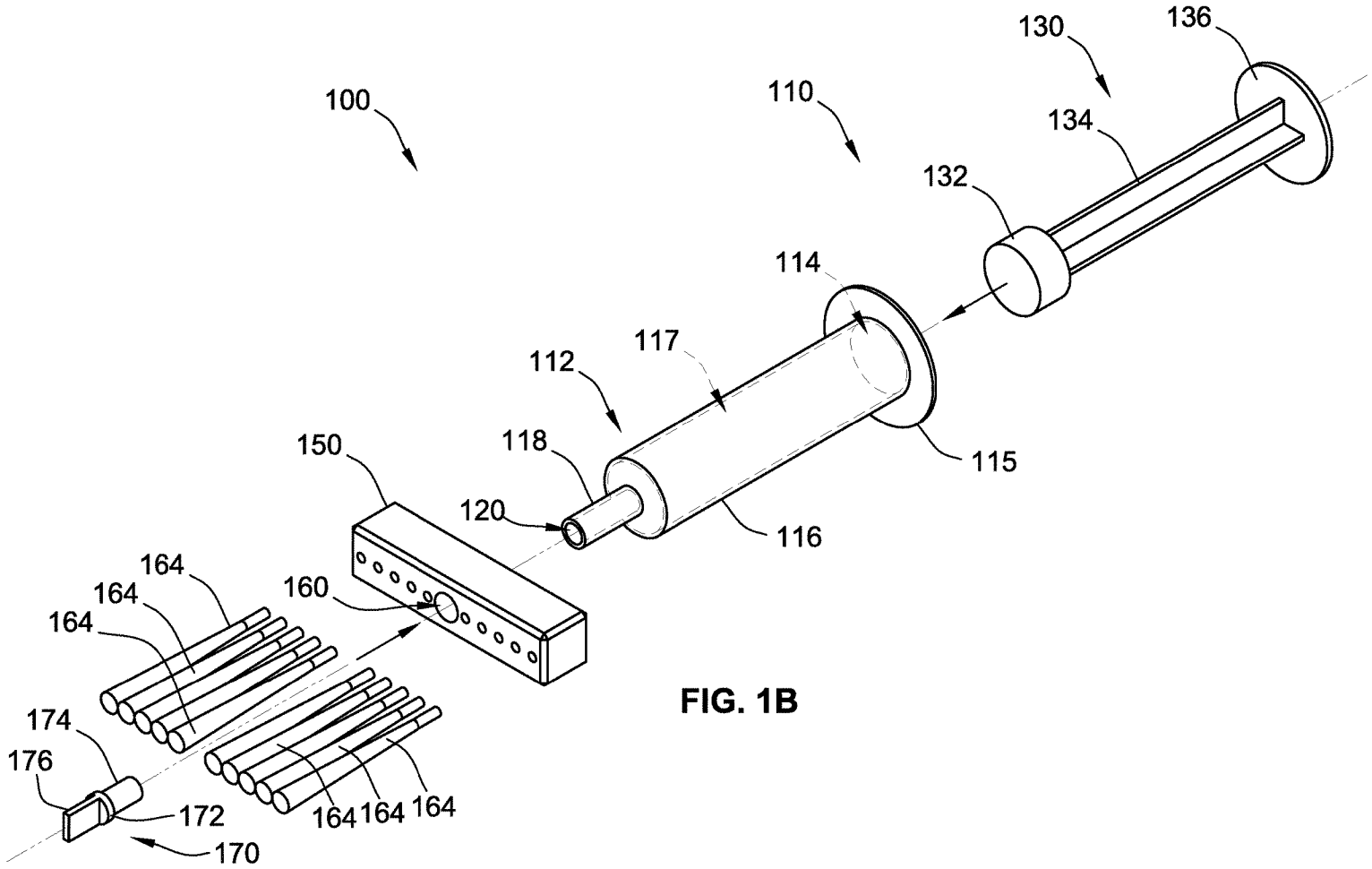
FIG. 1B is an exploded perspective view of the hair product applicator of FIG. 1A.

Referring generally to FIGS. 1A and 1B, a hair product applicator 100 includes a pump 110, a brushhead 150, a plurality of bristle bundles 164, and a cap 170. Generally, the hair product applicator 100 is used to dispense a composition stored in the pump 110 on the plurality of bristle bundles 164 when the cap 170 is removed for use in touching up a user's hair (e.g., edges, roots, etc. or any combination thereof).

As best shown in FIG. 1B, the pump 110 includes a housing 112 and a plunger 130. The housing 112 has an upper opening 114, a flange 115, a main body 116, an internal cavity 117, and a tip 118. The internal cavity 117 stores a composition therein. The composition can be any fluid and/or substance, such as, for example, a hair relaxer composition, a hair curling composition, a hair dye composition, a hair conditioning composition, a hair shampoo composition, etc., or any combination thereof. The relaxer composition is formulated to chemically react with hair (e.g., human hair) to relax (e.g., straighten) curls and/or waves occurring and/or present in the hair. Similarly, the hair curling composition is formulated to chemically react with hair (e.g., human hair) to introduce and/or cause curls therein.

The main body 116 of the housing 112 has a generally cylindrical configuration, although any other configurations are contemplated, such as, for example, a rectangular configuration, a triangular configuration, a polygonal configuration, or the like, or any combinations thereof. The housing 112 serves as a handle to aid a user in grasping and positioning the brushhead 150 during use of the hair product applicator 100. In some implementations, the main body 116 of the housing 112 further includes a pad (not shown) coupled to an outer surface thereof to aid the user in gripping and/or holding the housing 112, which can also provide ergonomic support (e.g., the pad can include finger grooves). The housing 112 can be made of, for example, a polymer material, a metal material, or the like, or any combination thereof. In some implementations, the housing 112 is made of a transparent or semi-transparent material such that the user can view the internal cavity 117 to determine the quantity of composition remaining therein.

The housing 112 can have a length that is between about two inches and about eight inches. For example, in some implementations, the housing 112 has a length that is about five inches. In addition, the main body 116 of the housing 112 can have a diameter that is between one-half of an inch and two inches. For example, in some implementations, the main body 116 has a diameter that is about three-quarters of one inch.

As best shown in FIG. 1B, the tip 118 of the housing 112 has a dispensing opening 120. The tip 118 and the dispensing opening 120 are in fluid communication with the internal cavity 117 such that the composition stored therein can flow through the tip 118 and the dispensing opening 120 when the pump 110 is activated as described herein. The tip 118 has a generally cylindrical configuration, although the tip 118 can have any other configuration (e.g., square, rectangular, triangular, or any polygonal configuration). As best shown in FIG. 1B, the main body 116 of the housing 112 has an outer diameter that is greater than an outer diameter of the tip 118. In some implementations, the outer diameter of the main body 116 is at least two times greater (e.g., two times, three times, four times, etc.) than the outer diameter of the tip 118 of the housing 112. Generally, the size and shape of the tip 118 are configured to aid in precisely dispensing the composition onto at least one of the plurality of bristle bundles 164, as described herein.

The plunger 130 has a piston head 132, a piston rod 134, and an actuation flange 136. The plunger 130 is slidably disposed through the upper opening 114 of the housing 112 (as shown in FIG. 1A) and within the internal cavity 117 such that the plunger 130 is moveable in the direction of arrow A. To cause the composition stored in the internal cavity 117 to be dispensed from the tip 118, a user moves the actuation flange 136 of the plunger 130 in the direction of arrow A. As the actuation flange 136 is moved towards the tip 118 in the direction of arrow A, the piston head 132 urges the composition stored in the internal cavity 117 to flow through the tip 118 and the dispensing opening 120. Moreover, the piston head 132 is disposed within the housing 112 such that the composition stored in the internal cavity 117 is prevented from escaping through the upper opening 114 of the housing 112.

As shown, the housing 112 can optionally include a flange 115 which aids in dispensing the composition by providing a surface for a user's fingers to gain leverage in moving the actuation flange 136. For example, a user's thumb can be placed on the actuation flange 136 and one or more of a user's fingers can be placed on a bottom surface of the flange 115, thus aiding the user in actuating the plunger 130 in the direction of arrow A. The plunger 130 can be made from the same material as the housing 112 and/or a different material or combination of materials.

As best shown in FIG. 1B, in some implementations, the cap 170 has a body 172, a plug 174, and an opposing handle 176. The plug 174 extends from the body 172 in a first direction and the opposing handle extends from the body 172 in a second opposing direction. The plug 174 is generally sized and shaped such that at least a portion of the plug is removably disposed within the tip 118. The plug 174 can be secured in the tip 118 by a friction fit, a press fit, a threaded connection, a magnetic connection, an adhesive connection, or the like, or any combination thereof. As shown, the opposing handle 176 has a generally rectangular configuration which aids in allowing a user to grasp the opposing handle 176 in order to remove the cap 170. However, other configurations are contemplated, such as, for example, a generally cylindrical configuration, a triangular configuration, a polygonal configuration, or the like. The cap 170 can be made from the same material as the housing 112 and/or a different material or combination of materials. For example, the cap 170 can be made of a polymer material, such as high-density polyethylene.

Disposing the plug 174 of the cap 170 in the tip 118 aids in preventing the composition from escaping the internal cavity 117 through the tip 118. Further, disposing the plug 174 of the cap 170 within the tip 118 and disposing the piston head 132 of the plunger 130 in the upper opening 114 creates an air-tight seal, thereby preventing ambient air or moisture from interacting with the composition. Thus, the cap 170 aids in extending the useful life of the hair product applicator 100.

As best shown in FIGS. 1B-2B, the brushhead 150 includes a first plurality of bristle bores 162*a*, a second plurality of bristle bores 162*b*, and a generally central throughhole 160. As shown, the brushhead 150 has a generally rectangular cuboid shape. As best shown in FIG. 2A, the brushhead 150 has a bottom surface 154*a*, an opposing top surface 154*b*, a first end 156*a*, an opposing second end 156*b*, a front surface 158*a*, and an opposing rear surface 158*b* such that the brushhead 150 defines the generally rectangular cuboid shape of the brushhead 150. However, other configurations are contemplated, such as, for example, a square cuboid configuration, generally cylindrical configuration, a triangular configuration, a polygonal configuration, or the like. Further, as shown, each edge of the brushhead 150 can be beveled and/or angled. The brushhead 150 can be made from the same material as the pump 110 or a different material and/or combination of materials. For example, the brushhead 150 can be made of a polymer material, such as high-density polyethylene, metal, plastic, etc. or any combination thereof.

The brushhead 150 can have a length that is between about one inch and about two and one-half inches. For example, in some implementations, the brushhead 150 has a length that is about one and one-half inches. In addition, the brushhead 150 can have a width that is between about one-tenth of an inch and about three-quarters of an inch. For example, in some implementations, the brushhead 150 has a width that is about four-tenths of an inch.

Figure 2A:
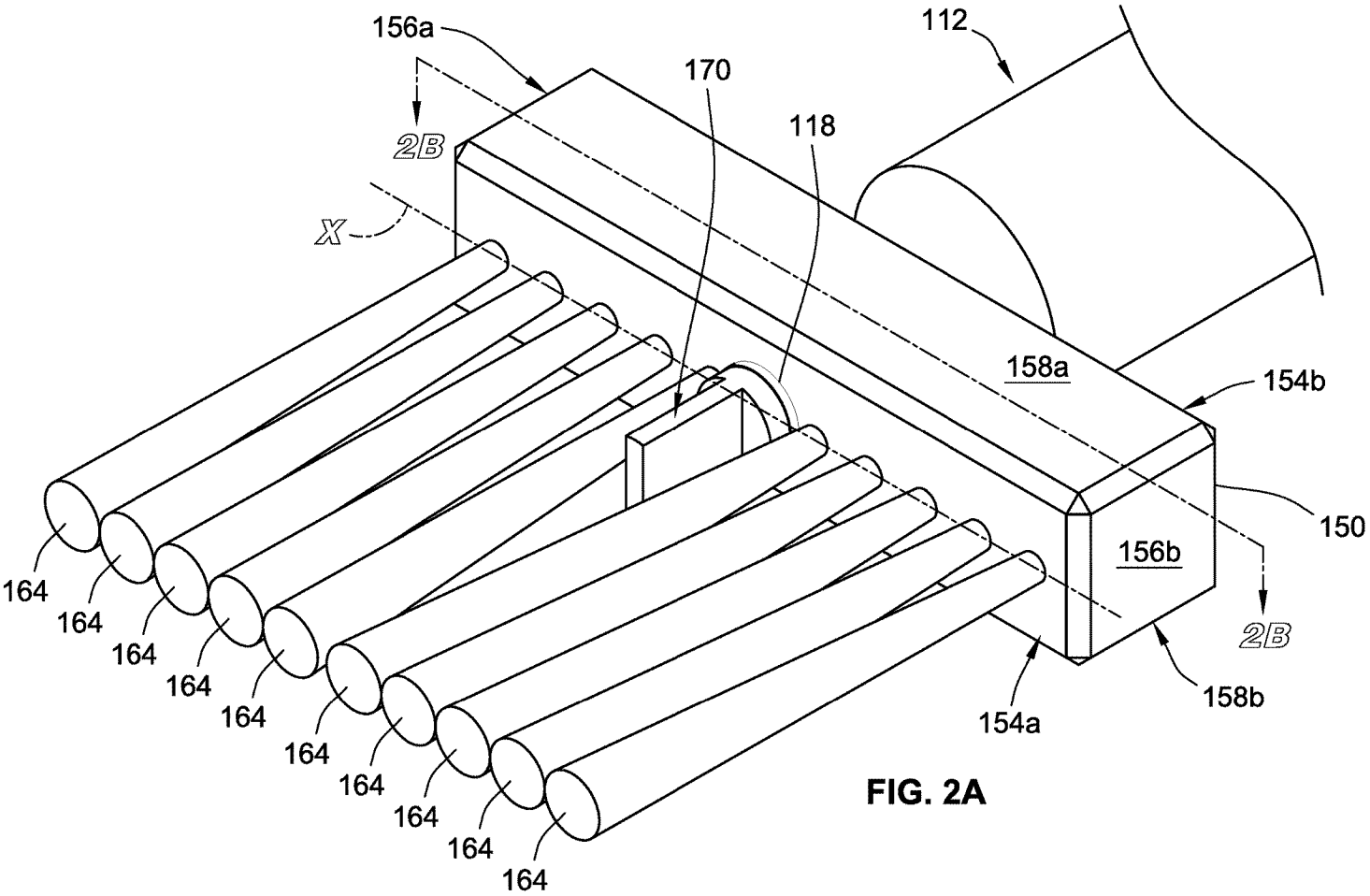
FIG. 2A is an enlarged perspective view of a brushhead of the hair product applicator of FIG. 1A.
Figure 2B:
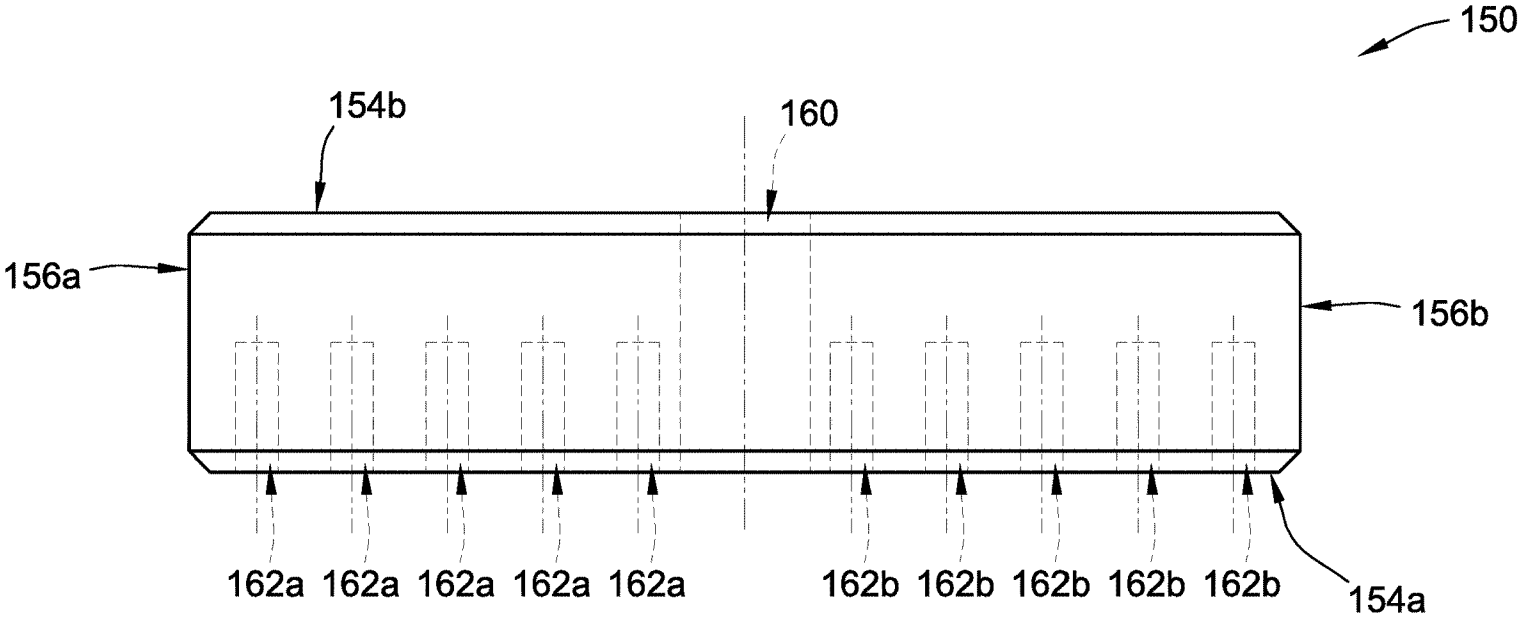
FIG. 2B is a front view of the brushhead of FIG. 2A.

Referring to FIG. 2B, the first plurality of bristle bores 162*a* and the second plurality of bristle bores 162*b* are each positioned on, and extend from, the bottom surface 154*a* of the brushhead 150 towards the opposing top surface 154*b*. As shown, the first plurality of bristle bores 162*a* and the second plurality of bristle bores 162*b* extend from the bottom surface 154*a* towards the opposing top surface 154*b* by a length that is about fifty percent of a distance between the bottom surface 154*a* and the opposing top surface 154*b*. Further, the first plurality of bristle bores 162*a* is positioned adjacent to the first end 156*a* of the brushhead 150 and the second plurality of bristle bores 162*b* is positioned adjacent to the second end 156*b* of the brushhead 150. While the first plurality of bristle bores 162*a* and the second plurality of bristle bores 162*b* are each shown as having five bristle bores, each plurality of bristle bores 162*a*, 162*b*, can have any number of bores, for example, three bores and three bores, seven bores and seven bores, two bores and eight bores, etc. As shown, the bristle bores 162*a*, 162*b* have a generally cylindrical configuration. However, other configurations are contemplated, such as, for example, a rectangular configuration, a triangular configuration, a polygonal configuration, or the like.

Each of the first plurality of bristle bores 162*a* and each of the second plurality of bristle bores 162*b* are configured to receive one of a plurality of bristle bundles 164 therein. Each of the plurality of bristle bundles 164 comprises a plurality of bristles. Each of the plurality of bristle bundles 164 can be secured within a corresponding one of the first plurality of bristle bores 162*a* or a corresponding one of the second plurality of bristle bores 162*b* such that the plurality of bristle bundles 164 extend from the bottom surface 154*a* of the brushhead 150. In some implementations, each of the plurality of bristle bundles 164 has an upper end wherein the plurality of bristles are bounded together by an adhesive connection, a locking collar, or the like, or any combination thereof. In such implementations, the upper end of each one of the plurality of bristle bundles 164 can be disposed within a corresponding one of the plurality of bristle bores 162*a*, 162*b* by a friction fit, a press fit, an adhesive connection, or the like, or any combination thereof.

Each of the plurality of bristle bundles 164 has a length between about one-half inch and about two inches. Preferably, the length of each of the plurality of bristles is about one inch. Each of the plurality of bristle bundles may be made of a synthetic material, such as nylon, or a natural material, such as a stiff hair, or any other suitable material.

As best shown in FIG. 2A, each of the first plurality of bristle bores 162*a* and each of the second plurality of bristle bores 162*b* are positioned such that each of the plurality of bristle bundles 164 contacts at least one adjacent one of the plurality of bristle bundles 164. Further, the first plurality of bristle bores 162*a* and the second plurality of bristle bores 162*b* are arranged along line X such that the plurality of bristle bundles 164 form a single, straight row of bristle bundles. When applying relaxer agent to hair, a user may desire to apply the relaxer agent to a target area along the edges of the user's hairline, and more specifically, at or near the root of the hair. Because the relaxer composition chemically reacts with hair, it may be undesirable for the relaxer agent to contact portions of the hair other than the target area. Thus, advantageously, the single, straight row of bristle bundles 164 allows a user to precisely place at least a portion of the plurality of bristle bundles 164 at or near the target area without the bristles undesirably interfering with or contacting other portions of the user's hair.

As shown, the generally central throughhole 160 extends between the bottom surface 154*a* of the brushhead 150 and the opposing top surface 154*b* and is positioned between the first plurality of bristle bores 162*a* and the second plurality of bristle bores 162*b*. The generally central throughhole 160 is sized and shaped such that it can receive the tip 118 of the housing 112 of the pump 110, thus coupling the pump 110 to the brushhead 150. In some implementations, the tip 118 of the housing 112 can be secured within the generally central throughhole 160 by a friction fit, a press fit, an adhesive connection, a magnetic connection, or the like, or any combination thereof. Alternatively, the tip 118 can be secured within the generally central throughhole 160 by a threaded connection between an outer surface of the tip 118 and the generally central throughhole 160.

In some implementations, a portion of the generally central throughhole 160 adjacent to the opposing top surface 154*b* can have a counterbore configuration such that the tip 118 and a portion of the housing 112 can be disposed within the generally central throughhole 160, further aiding in securing in the pump 110 to the brushhead 150. Further, in some implementations, a lower portion of the main body 116 of the housing 112 can have a generally conical profile. In such implementations, the portion of the generally central throughhole 160 adjacent to the opposing top surface 154*b* can have a countersink configuration such that the tip 118 and the lower portion of the housing 112 having a generally conical profile can be disposed within the generally central throughhole 160, further aiding in securing the pump 110 to the brushhead 150.

As best shown in FIG. 2A, a portion of the tip 118 of the housing 112 protrudes through the generally central throughhole 160 and extends beyond the bottom surface 154*a* of the brushhead 150. Thus, the dispensing opening 120 of the tip 118 is positioned such that actuation of the plunger 130, as described above, causes at least a portion of composition to be dispensed on at least one of the plurality of bristle bundles 164

To assemble the hair product applicator 100, the piston head 132 of the plunger 130 is inserted into the upper opening 114 of the housing 112 such that the plunger 130 is moveable in the direction of arrow A, as described above. To fill the internal cavity 117 with the composition, the tip 118 is placed in a volume of the composition. Movement of the plunger 130 in the opposite direction of arrow A (FIG. 1A) causes the composition to be drawn into the internal cavity 117. As described above, the flange 115 of the housing 112 aids the user in gaining leverage to move the plunger 130. Movement of the plunger 130 in this manner creates a suction force which urges the composition through the dispensing opening 120 and the tip 118. Alternatively, in some implementations, the composition can be directly injected into the internal cavity 117 through the dispensing opening 120 and the tip 118. In such implementations, injection of the composition into the internal cavity 117 urges the piston head 132, and consequently the plunger 130, to move in the opposite direction of arrow A. Once the internal cavity 117 is filled with the composition, the cap 170 is disposed within the tip 118 as described above in order to prevent the composition from escaping the internal cavity 117 and to provide an air-tight seal. The tip 118 of the housing 112 is disposed in the generally central throughhole 160 of the brushhead 150 such that the pump 110 is coupled to the brushhead 150, as described above. One of the plurality of bristle bundles 164 is fixed in each of the first plurality of bristle bores 162*a* and each of the second plurality of bristle bores 162*b*, as described above.

Figure 3A:
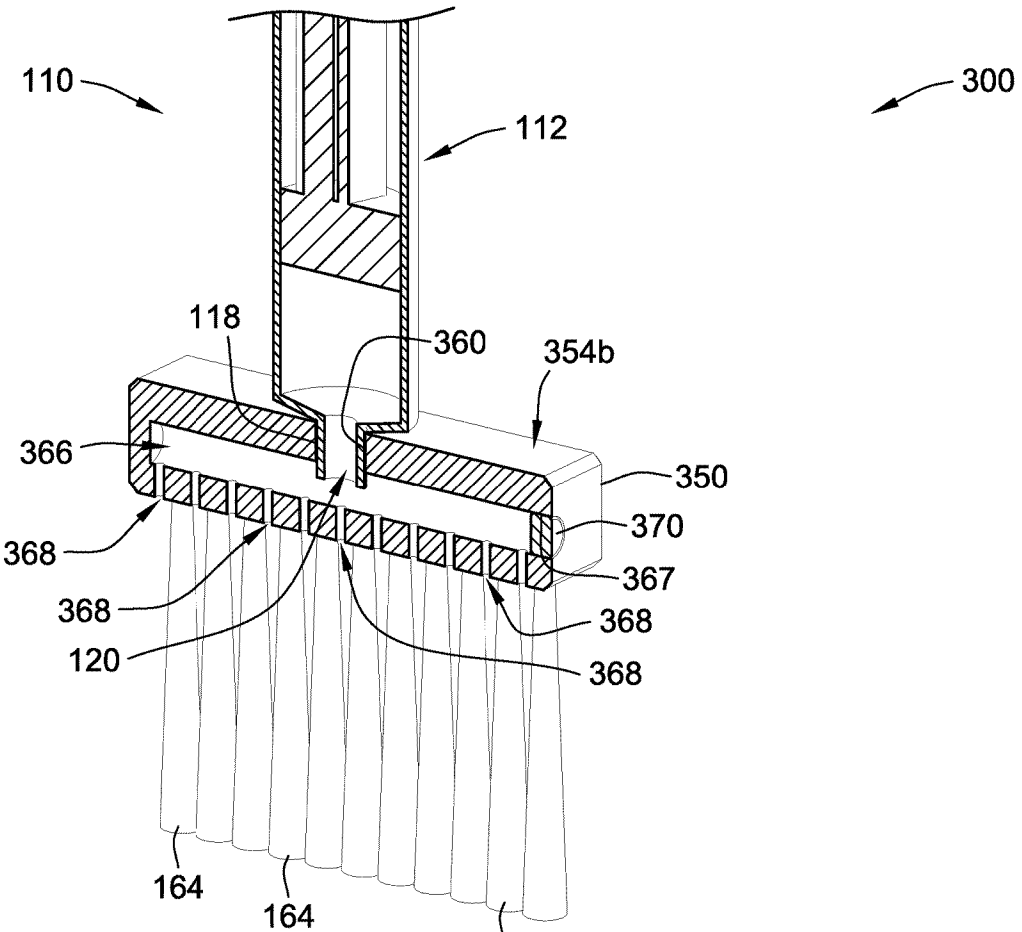
FIG. 3A is a partial perspective cross-sectional view of a hair product applicator according to some implementations of the present disclosure.
Figure 3B:
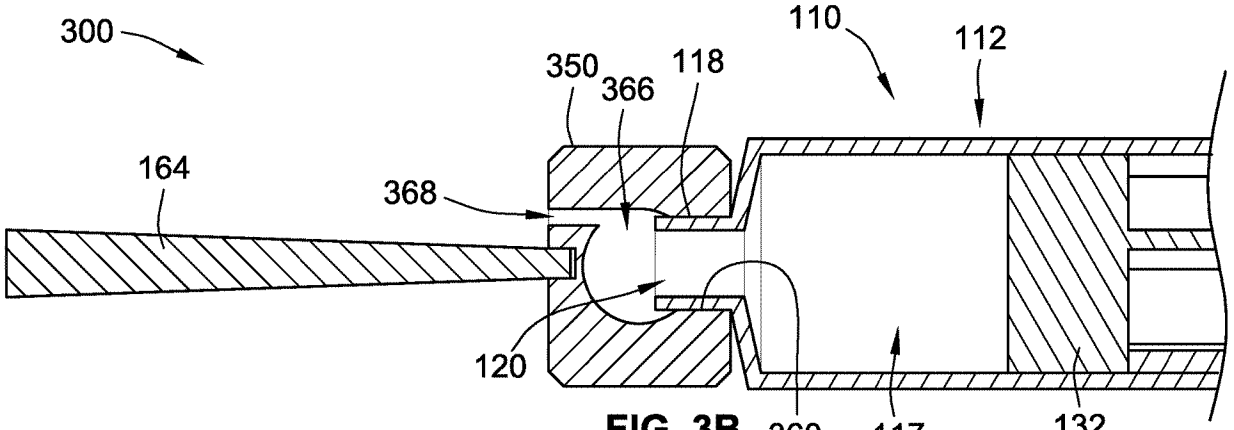
FIG. 3B is a partial side cross-sectional view of the hair product applicator of FIG. 3A.
Figure 3C:
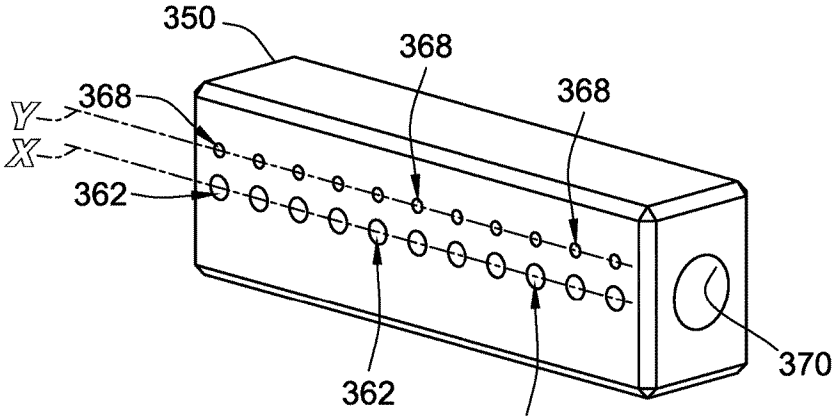
FIG. 3C is a bottom perspective view of a brushhead of the hair product applicator of FIG. 3A.

Referring to FIGS. 3A-3C, a hair product applicator 300 includes the pump 110, a brushhead 350, the plurality of bristle bundles 164, and a cap 370. The brushhead 350 is similar to the brushhead 150 (FIGS. 1A-2B) in that it has a generally rectangular cuboid configuration and has a plurality of bristle bores 362 that are the same as or similar to the first and second plurality of bristle bores 162*a*, 162*b* of the brushhead 150. The brushhead 350 differs from the brushhead 150 in that it includes a generally central aperture 360, a central cavity 366, and a plurality of dispensing openings 368.

Referring to FIGS. 3A and 3B, the generally central aperture 360 is similar to the generally central throughhole 160 of the brushhead 150 in that it is configured to receive the tip 118 therein such that the pump 110 can be coupled to the brushhead 350 in a similar manner as the brushhead 150. However, the generally central aperture 360 differs from the generally central throughhole 160 in that it extends between a top surface 354*b* of the brushhead 350 and the central cavity 366, as opposed to between the top surface 354*b* and a bottom surface of the brushhead 350 (FIGS. 3A and 3B)

As best shown in FIG. 3A, the central cavity 366 extends along a width of the brushhead 350 and has an end opening 367. The central cavity 366 has a generally cylindrical configuration, although any other configurations are contemplated, such as, for example, a rectangular configuration, a triangular configuration, a polygonal configuration, or the like. As best shown in FIG. 3B, a portion of the tip 118 of the housing 112 protrudes into the central cavity 366. Thus, the dispensing opening 120 of the tip 118 is positioned such that actuation of the plunger 130, as described above, causes at least a portion of the composition to be dispensed in the central cavity 366.

Referring to FIG. 3A, the hair product applicator 300 further includes a cap 370 disposed within the central cavity 366 at the end opening 367. The cap 370 is configured to prevent the composition from escaping from the end opening 367 of the central cavity 366 and provide an air-tight seal. The cap 370 can be secured within the central cavity 366 by a friction fit, a press fit, a threaded connection, a magnetic connection, an adhesive connection, or the like, or any combination thereof.

Referring to FIGS. 3A and 3C, the brushhead 350 includes a plurality of dispensing openings 368. As best shown in FIG. 3C, the plurality of dispensing openings 368 are arranged along line Y and the plurality of bristle bores 362 are arranged along line X As shown, line Y is spaced from line X. Alternatively, the plurality of dispensing openings 368 and the plurality of bristle bores 362 can both be positioned along line X such that each one of the plurality of dispensing openings 368 are positioned between a pair of the bristle bores 362.

Each of the plurality of dispensing openings 368 are in fluid communication with the central cavity 366 such that upon actuation of the pump 110 and dispensing a portion of the composition stored in the internal cavity 117 into the central cavity 366 as described above, the composition is dispensed through the plurality of dispensing openings 368. Thus, the plurality of dispensing openings 368 cause at least a portion of the composition to be dispensed on the plurality of bristle bundles 164. Advantageously, by providing a plurality of dispensing openings 368, as opposed to a single opening (e.g., the dispensing opening 120 of the hair product applicator 100), the composition is spread onto at least a portion of each of the plurality of bristle bundles 164.

The hair product applicator 300 can be assembled in the same or similar manner as the hair product applicator 100.

Alternatively, in some implementations, the brushhead 350 includes a first half (not shown) and a second half (not shown). In such implementations, the first half has a first central cavity and the second half has a second central cavity. Responsive to the first half being aligned with and coupled to the second half, the first central cavity and the second central cavity are in fluid communication with one another and form a central cavity that is the same as or similar to the central cavity 366 shown in FIG. 3A. Various methods of coupling the first half and the second half are contemplated, such as, for example, an adhesive connection, a welded connection, a pin and aperture system, a locking collar, tabs, or the like, or any combination thereof. This configuration differs from the configuration shown in FIGS. 3A-3C in that there is no end opening of the central cavity.

In some implementations, a first shrink film (not shown) can be positioned on a first side of the hair product applicator 100, 300 and a second shrink film (not shown) can be positioned on an opposing second side of the hair product applicator 100, 300. The first shrink film and the second shrink film can be configured to shrink and adhere to one another upon the application of heat. For example, the first shrink film and the second shrink film can be made of a polymer material, such as polyolefin. In this configuration, heat can be applied such that the first shrink film and the second shrink film adhere to one another and encapsulate the hair product applicator. Advantageously, the first shrink film and the second shrink film can form an air-tight packaging for the hair product applicator, which further aids in providing an air-tight seal for the composition stored in the internal cavity 117. Thus, the first shrink film and the second shrink film can extend the useful life of the hair product applicator 100, 300.

Although the hair product applicators 100, 300 of the present disclosure are shown and described as being used to dispense and/or apply hair related compositions (e.g., a hair relaxer composition), the same, or similar, applicators can be used to apply any fluid and/or substance, such as, for example, water, oil, paint, dye, glue, liquid soap or detergent, or the like, or any combination thereof.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the invention. It is also contemplated that additional embodiments according to aspects of the present invention may combine any number of features from any of the embodiments described herein.

What is claimed:

1. A single use hair product applicator, comprising:

a pump including a housing and a plunger, the housing having (i) an upper opening, (ii) a cavity configured to store a composition therein, (iii) a tip having a dispensing opening, and (iv) an outer flange extending circumferentially around the upper opening for aiding a user in actuating the plunger in a first linear direction, the plunger being slidably disposed within the housing such that the plunger is moveable with respect to the housing and aids in preventing the composition from escaping through the upper opening of the housing;

a brushhead including a first plurality of bristle bores, a second plurality of bristle bores, and a generally central throughhole, the first plurality of bristle bores being adjacent to a first end of the brushhead and the second plurality of bristle bores being adjacent to an opposing second end of the brushhead, each of the first plurality of bristle bores and each of the second plurality of bristle bores (i) extending from a bottom surface of the brushhead towards an opposing top surface of the brushhead and (ii) having a bristle bundle extending therefrom, the generally central throughhole extending between the bottom surface and the opposing top surface and being positioned between the first plurality of bristle bores and the second plurality of bristle bores, the pump being coupled to the brushhead via the tip of the housing such that actuation of the plunger in the first linear direction causes at least a portion of the composition stored in the housing to be dispensed directly onto at least a portion of the bristle bundles; and a cap configured to be removably coupled with the tip of the housing such that the cap aids in preventing the composition from escaping from the dispensing opening of the tip.

2. The single use hair product applicator of claim 1, wherein the cap has a body, a plug, and a handle, the plug extending from the body in a first direction and the handle extending from the body in a second opposing direction, at least a portion of the plug being configured to be removably disposed within the tip of the housing.

3. The single use hair product applicator of claim 2, wherein the body of the cap and the plug of the cap each have a generally cylindrical profile and the handle of the cap has a generally rectangular profile to aid in allowing a user to grasp the handle in order to remove the cap from the tip of the housing.

4. The single use hair product applicator of claim 1, wherein the brushhead has a generally rectangular cuboid shape.

5. The single use hair product applicator of claim 1, wherein the first plurality of bristle bores and the second plurality of bristle bores are arranged along a straight line such that the bristle bundles form a single, straight row of bristle bundles.

6. The single use hair product applicator of claim 1, wherein the brushhead has a length that is between about 1 inch and about 2.5 inches.

7. The single use hair product applicator of claim 1, wherein the composition is a relaxer agent.

8. The single use hair product applicator of claim 1, wherein a main body portion of the housing of the pump has an outer diameter that is at least two times greater than an outer diameter of the tip of the housing.

9. The single use hair product applicator of claim 1, wherein a portion of the tip of the housing protrudes beyond the bottom surface of the brushhead.

10. A method for assembling a hair product applicator, the method comprising:

providing a housing having (i) an upper opening, (ii) a cavity, (iii) a tip having a dispensing opening, and (iv) an outer flange extending circumferentially around the upper opening for aiding a user in actuating the plunger in a first linear direction;

sildably engaging a plunger with the housing through the upper opening of the housing;

filling a portion of the cavity with a composition;

sealing the tip of the housing with a cap such that the cap aids in preventing the composition from escaping from the dispensing opening of the tip;

coupling the tip of the housing with a generally central throughhole of a brushhead, the brushhead including a first plurality of bristle bores, a second plurality of bristle bores, and the generally central throughhole, the first plurality of bristle bores being adjacent to a first end of the brushhead and the second plurality of bristle bores being adjacent to an opposing second end of the brushhead, each of the first plurality of bristle bores and each of the second plurality of bristle bores at least partially extending from a bottom surface of the brushhead towards an opposing top surface, the generally central throughhole extending between the bottom surface and opposing top surface and being positioned between the first plurality of bristle bores and the second plurality of bristle bores; and fixing a bristle bundle in each of the first plurality of bristle bores and in each of the second plurality of bristle bores such that a least a portion of the bristle bundles is positioned to directly receive at least a portion of the composition thereon responsive to (i) the cap being removed, thereby unsealing the tip and (ii) the plunger moving with respect to the housing towards the tip, thereby causing a portion of the composition to be dispensed through the dispensing opening via the tip.

11. The method of claim 10, wherein the composition is a relaxer agent.

12. The method of claim 10, wherein the filling the portion of the cavity with the composition includes (i) placing the dispensing opening of the tip in a volume of the composition and (ii) moving the plunger from a second position to a first position such that the composition is drawn into the cavity.

13. The single use hair product applicator of claim 1, wherein the plunger has a piston head, a piston rod, and an actuation flange.

14. A hair product applicator comprising:

a pump including a housing and a plunger, the housing having (i) an upper opening, (ii) a cavity configured to store a composition therein, and (iii) a tip having a dispensing opening, the plunger being slidably disposed within the housing such that the plunger is moveable with respect to the housing and aids in preventing the composition from escaping through the upper opening of the housing; and a brushhead including a first plurality of bristle bores, a second plurality of bristle bores, a generally central aperture, and a plurality of dispensing openings, the first plurality of bristle bores being adjacent to a first end of the brushhead and the second plurality of bristle bores being adjacent to an opposing second end of the brushhead, each of the first plurality of bristle bores and each of the second plurality of bristle bores (i) extending from a bottom surface of the brushhead towards an opposing top surface of the brushhead and (ii) having a bristle bundle extending therefrom, the generally central aperture extending between the opposing top surface and the central cavity, the plurality of dispensing openings extending between the central cavity and the bottom surface, the pump being coupled to the brushhead via the tip of the housing such that actuation of the plunger causes at least a portion of the composition stored in the housing to be dispensed directly onto at least a portion of the bristle bundles.

15. The hair product applicator of claim 14, wherein each of the plurality of dispensing openings is positioned adjacent to one of the plurality of bristle bores to aid in dispensing the composition directly onto at least a portion of each of the bristle bundles.

* * * * *